US010400369B2

(12) United States Patent
Altmann et al.

(10) Patent No.: US 10,400,369 B2
(45) Date of Patent: Sep. 3, 2019

(54) SHAPEWEAR GARMENT WITH MESH REGIONS

(71) Applicant: HBI Branded Apparel Enterprises, LLC, Winston Salem, NC (US)

(72) Inventors: Heinz Altmann, Winston-Salem, NC (US); Carmelo Padin, Clarksville, AR (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 0 days.

(21) Appl. No.: 16/130,612

(22) Filed: Sep. 13, 2018

(65) Prior Publication Data

US 2019/0075853 A1 Mar. 14, 2019

Related U.S. Application Data

(60) Provisional application No. 62/558,733, filed on Sep. 14, 2017.

(51) Int. Cl.
*D04B 1/24* (2006.01)
*A41B 9/06* (2006.01)
(Continued)

(52) U.S. Cl.
CPC ..... *D04B 1/246* (2013.01); *A41B 9/06* (2013.01); *A41D 1/18* (2013.01); *A41D 27/28* (2013.01);
(Continued)

(58) Field of Classification Search
CPC . D04B 1/24; D04B 1/246; D04B 1/18; D04B 1/104; A41B 9/06; A41B 2400/20; A41B 2400/38; A41D 24/28; A41D 1/18
See application file for complete search history.

(56) References Cited

U.S. PATENT DOCUMENTS 737,975 A 9/1903 Trimble
2,285,012 A 6/1942 Burkey
(Continued)

FOREIGN PATENT DOCUMENTS

DE 102011000398 4/2012
EP 1367161 12/2003
FR 2899068 10/2007

OTHER PUBLICATIONS

International Search Report and Written Opinion in International Application No. PCT/US2018/022971, dated Jun. 6, 2018, 11 pages.

(Continued)

*Primary Examiner* — Danny Worrell
(74) *Attorney, Agent, or Firm* — Fish & Richardson P.C.

(57) ABSTRACT

The subject matter of this specification can be embodied in, among other things, a garment that includes a body having a first end and a second end opposite the first end. The body has an anterior knit region having a first knitting pattern configured to stretch across a portion of a wearer's abdominal area, a second knitting pattern configured to stretch across a portion of a wearer's chest area, a posterior knit region having the first knitting pattern configured to stretch about a portion of the wearer's back, a first lateral knit region having a third knitting pattern different from the first knitting pattern configured to stretch about a portion of the wearer's left lateral area, and a second lateral knit region having the third knitting pattern configured to stretch about a portion of the wearer's right lateral area.

16 Claims, 6 Drawing Sheets

(51) Int. Cl.

| | |
|---|---|
| ***A41D 27/28*** | (2006.01) |
| ***A41D 1/18*** | (2006.01) |
| ***D04B 1/10*** | (2006.01) |
| ***D04B 1/18*** | (2006.01) |
| *A41C 1/06* | (2006.01) |

(52) U.S. Cl.
CPC ..... *D04B 1/104* (2013.01); *D04B 1/18* (2013.01); *A41B 2400/20* (2013.01); *A41B 2400/38* (2013.01); *A41B 2500/10* (2013.01); *A41C 1/06* (2013.01); *A41D 2400/38* (2013.01); *A41D 2500/10* (2013.01)

(56) References Cited

U.S. PATENT DOCUMENTS

| | | | | |
|---|---|---|---|---|
| 3,526,229 | A | 9/1970 | Blair | |
| 3,625,029 | A | 12/1971 | Safrit et al. | |
| 3,946,579 | A * | 3/1976 | Heinig | A41B 9/004 66/177 |
| 5,590,548 | A | 1/1997 | Osborne | |
| 5,689,836 | A | 11/1997 | Fee | |
| 5,888,118 | A | 3/1999 | Kishi | |
| 6,041,441 | A | 3/2000 | Counts | |
| 6,401,250 | B1 | 6/2002 | McNabb | |
| 6,651,463 | B2 | 11/2003 | Bonnin | |
| 7,024,892 | B2 | 4/2006 | Blakely | |
| 7,260,961 | B1 | 8/2007 | Kennedy | |
| 7,441,418 | B2 * | 10/2008 | Delgado-Mecinas | A41B 9/00 66/169 R |
| 7,509,822 | B2 | 3/2009 | Ishida | |
| 7,526,929 | B2 * | 5/2009 | Takamoto | A41B 11/14 66/177 |
| 8,381,314 | B2 | 2/2013 | Takamoto | |
| 9,655,388 | B2 | 5/2017 | Michel | |
| 10,053,804 | B2 | 8/2018 | Frantz | |
| 10,294,593 | B2 * | 5/2019 | Padin | D04B 1/104 |
| 2001/0035032 | A1 | 11/2001 | Blakely | |
| 2004/0016043 | A1 | 1/2004 | Uno et al. | |
| 2004/0045325 | A1 | 3/2004 | Rabinowicz | |
| 2014/0000004 | A1 | 1/2014 | Baron et al. | |
| 2018/0249777 | A1 | 9/2018 | Turner | |

OTHER PUBLICATIONS

International Search Report and Written Opinion in International Application No. PCT/US2018/050899, dated Dec. 5, 2018, 17 pages.

* cited by examiner

SHAPEWEAR GARMENT WITH MESH REGIONS

CROSS-REFERENCE TO RELATED APPLICATIONS

This application claims the benefit of priority to U.S. Provisional Application Ser. No. 62/558,733, filed on Sep. 14, 2017, the contents of which are hereby incorporated by reference.

TECHNICAL FIELD

This disclosure relates to garments, for example, women's shapewear undergarments or underwear.

BACKGROUND

Shapewear garments exist in a number of forms, such as bodysuits, waist cinchers, and shaping tops. Each style provides a different combination of fit, comfort, support, and shaping. During normal movement or athletic activity, discomfort can result from body heat and/or perspiration that can build up between the wearer's skin and the garment.

SUMMARY

In general, this document describes garments, for example, women's shapewear undergarments or underwear.

In a first aspect, a garment includes a body having a first end and a second end opposite the first end, the body having an anterior knit region having a first knitting pattern configured to stretch across a portion of a wearer's abdominal area, a second knitting pattern configured to stretch across a portion of a wearer's chest area, a first outer edge and a second outer edge, a posterior knit region having the first knitting pattern, a third outer edge and a fourth outer edge, and configured to stretch about a portion of the wearer's back, a first lateral knit region having a third knitting pattern different from the first knitting pattern, extending between the first outer edge of the anterior knit region and the third outer edge of the posterior knit region, and configured to stretch about a portion of the wearer's left lateral area and a lateral portion of the wearer's left hip, and a second lateral knit region having the third knitting pattern, extending between the outer edge of the anterior knit region and the outer edge of the posterior knit region, and configured to stretch about a portion of the wearer's right lateral area and a lateral portion of the wearer's right hip.

Various embodiments can include some, all, or none of the following features. The anterior knit region, the first lateral knit region, the posterior knit region, and the second lateral knit region can be formed together as a circularly knit, tubular body. The wearer's chest area can include the wearer's breasts. The third knitting pattern can be a knit mesh pattern. Regions having the third knitting pattern can have a weight of less than 8.5 ounces per square yard. Regions having the third knitting pattern can be elastic 2×2 float knit structures having a ground yarn covered with an elastomer that is float plated with a nylon thread. The third knitting pattern can have a collection of groups of three first openings arranged in a line, wherein the groups are spaced apart by a collection of second openings that are smaller than the first openings, and regions having the second knitting pattern include about three-hundred of the groups per square inch when the knit mesh is relaxed. The garment can also include a tubular waistband attached to the anterior knit region, the first lateral knit region, the posterior knit region, and the second lateral knit region at the second end of the body. The first knitting pattern can have a single or double jersey knit structure. The second knitting pattern can be a knit mesh pattern having greater stretch and breathability than the first knitting pattern, but a lesser stretch and breathability than the third knitting pattern. The first knitting pattern can be the same as the second knitting pattern. The garment can be an undergarment.

In a second aspect, a method of making a garment includes circularly knitting a tubular blank to form a body of a garment, the body having a first end and a second end opposite the first end and having an anterior knit region having a first knitting pattern configured to stretch across a portion of a wearer's abdominal area, and a second knitting pattern configured to stretch across a portion of a wearer's chest area, having a first outer edge and a second outer edge, a posterior knit region having the first knitting pattern, having a third outer edge and a fourth outer edge, and configured to stretch about a portion of the wearer's back, a first lateral knit region having a third knitting pattern different from the first knitting pattern, extending between the first outer edge and the third outer edge, and configured to stretch about a portion of the wearer's left lateral area and a lateral portion of the wearer's left hip, and a second lateral knit region having the second knitting pattern, extending between the second outer edge and the fourth outer edge, and configured to stretch about a portion of the wearer's right lateral area and a lateral portion of the wearer's right hip, cutting a first arm hole proximal the first end through the first lateral knit region, a first portion of the anterior knit region, and a first portion of the posterior knit region, cutting a second arm hole proximal the first end through the second lateral knit region, a second portion of the anterior knit region, and a second portion of the posterior knit region, cutting a first neck hole portion proximal the first end through a third portion of the anterior knit region, cutting a second neck hole portion proximal the first end through a fourth portion of the posterior knit region, joining the anterior knit region to the posterior knit region proximal the first end to form a first shoulder strap, and joining the anterior knit region to the posterior knit region proximal the first end to form a second shoulder strap.

Various implementations can include some, all, or none of the following features. The method can also include knitting the third knitting pattern in a knit mesh pattern. Regions having the third knitting pattern can have a weight of less than 8.5 ounces per square yard. Regions having the third knitting pattern can be elastic 2×2 float knit structures having a ground yarn covered with an elastomer float plated with a nylon thread. The third knitting pattern can include a collection of groups of three first openings arranged in a line, wherein the groups are spaced apart by a collection of second openings that are smaller than the first openings, and the regions having the second knitting pattern have about three-hundred of the groups per square inch when the knit mesh is relaxed. The first knitting pattern can be a single or double jersey knit structure. The first knitting pattern can be the same as the second knitting pattern. The second knitting pattern can be a knit mesh pattern having greater stretch and breathability than the first knitting pattern, but a lesser stretch and breathability than the third knitting pattern.

The systems and techniques described here may provide one or more of the following advantages. First, a system can provide a garment with additional flexibility and breathability in target areas of the garment to increase comfort for a wearer of the garment.

The details of one or more implementations are set forth in the accompanying drawings and the description below. Other features and advantages will be apparent from the description and drawings, and from the claims.

DETAILED DESCRIPTION

This disclosure describes shapewear garments, for example, undergarments to shape, support, and contour the torso (e.g., a shapewear camisole). In general, the garments include knit meshes in certain portions of the shapewear garment, and the knit meshes have elastic and ventilation properties that differ from those of other regions of the garment.

FIGS. 1-4 are front (e.g., anterior), rear (e.g., posterior), right, and left views of an example undergarment 100. The undergarment 100 includes a body 110 (e.g., a camisole body), a waistband 150, and a pair of shoulder straps 112*a* and 112*b*. The shoulder straps 112*a*, 112*b* define an arm hole 114*a*, and arm hole 114*b*, and a neck hole 116. While FIGS. 1-4 refer to an example undergarment, the garment may also be an outer garment.

Figure 1:
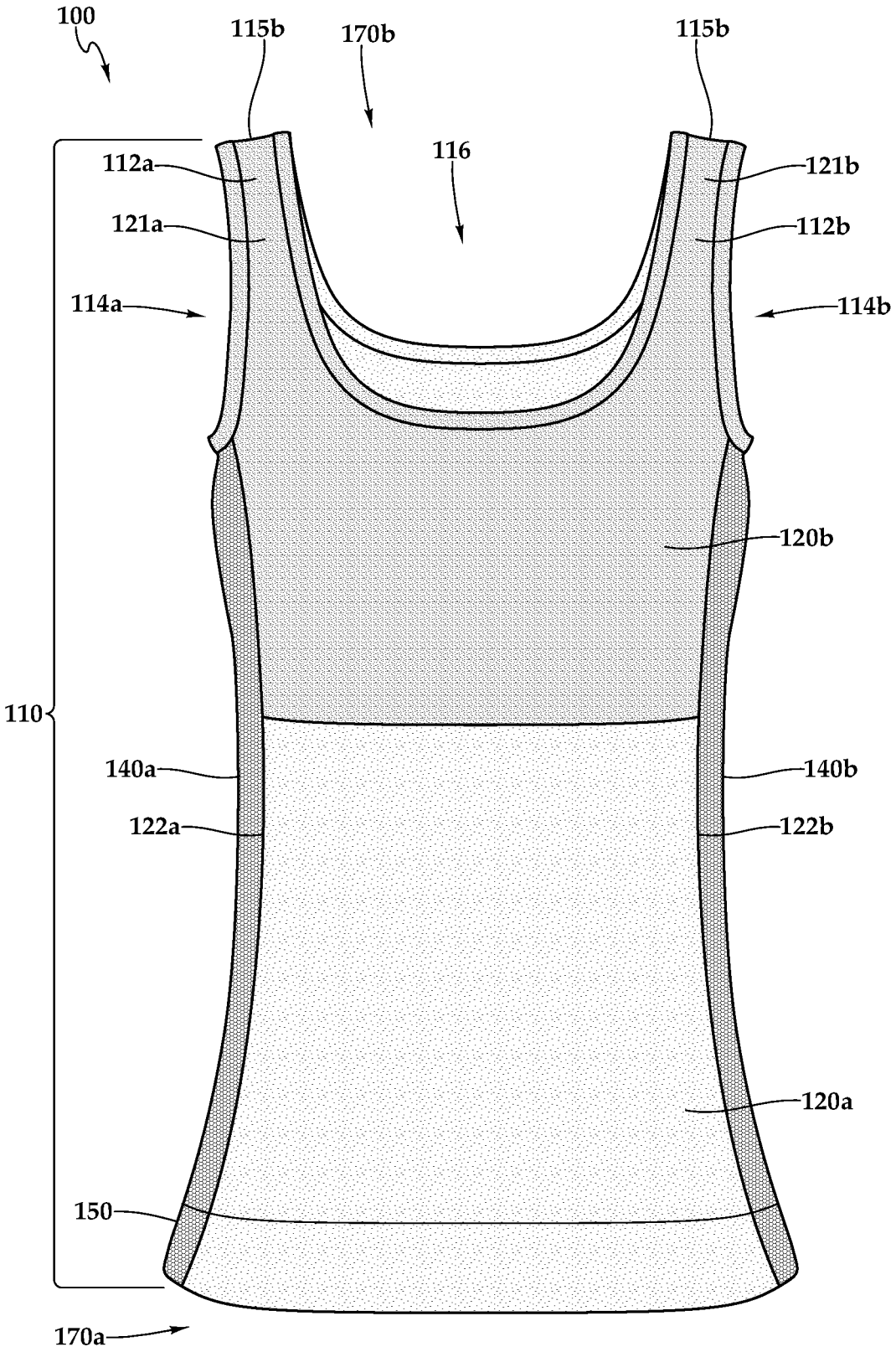
FIG. 1 is a front view of an example undergarment.

Referring mainly to FIG. 1, the body 110 is a circularly knit garment that includes an anterior knit region 120*a* and an anterior knit region 120*b*. The anterior knit region 120*a* is arranged to extend substantially across a wearer's lower torso and abdomen when worn. The anterior knit region 120*b* is arranged to extend substantially across a wearer's upper torso and chest (e.g., bra area, breasts) when worn. The anterior knit regions 120*a* and 120*b* share an outer edge 122*a* and an outer edge 122*b*.

In some instances, circularly knitting the garment produces a seamless garment, for example, where different regions of the garment can be seamlessly joined to each other. In some instances, when the garment is worn by a wearer, the anterior knit region 120*a* stretches to some degree over the wearer's abdominal area to provide shaping compression. In some instances, when the garment is worn by a wearer, the anterior knit region 120*b* stretches to some degree to provide support for the wearer's breasts (e.g., the anterior knit region 120*b* acts as a built-in bra). In some instances, the anterior knit region 120*b* may be formed using a knit pattern that has a greater degree of stretchability and/or breathability than the anterior knit region 120*a*.

Figure 2:
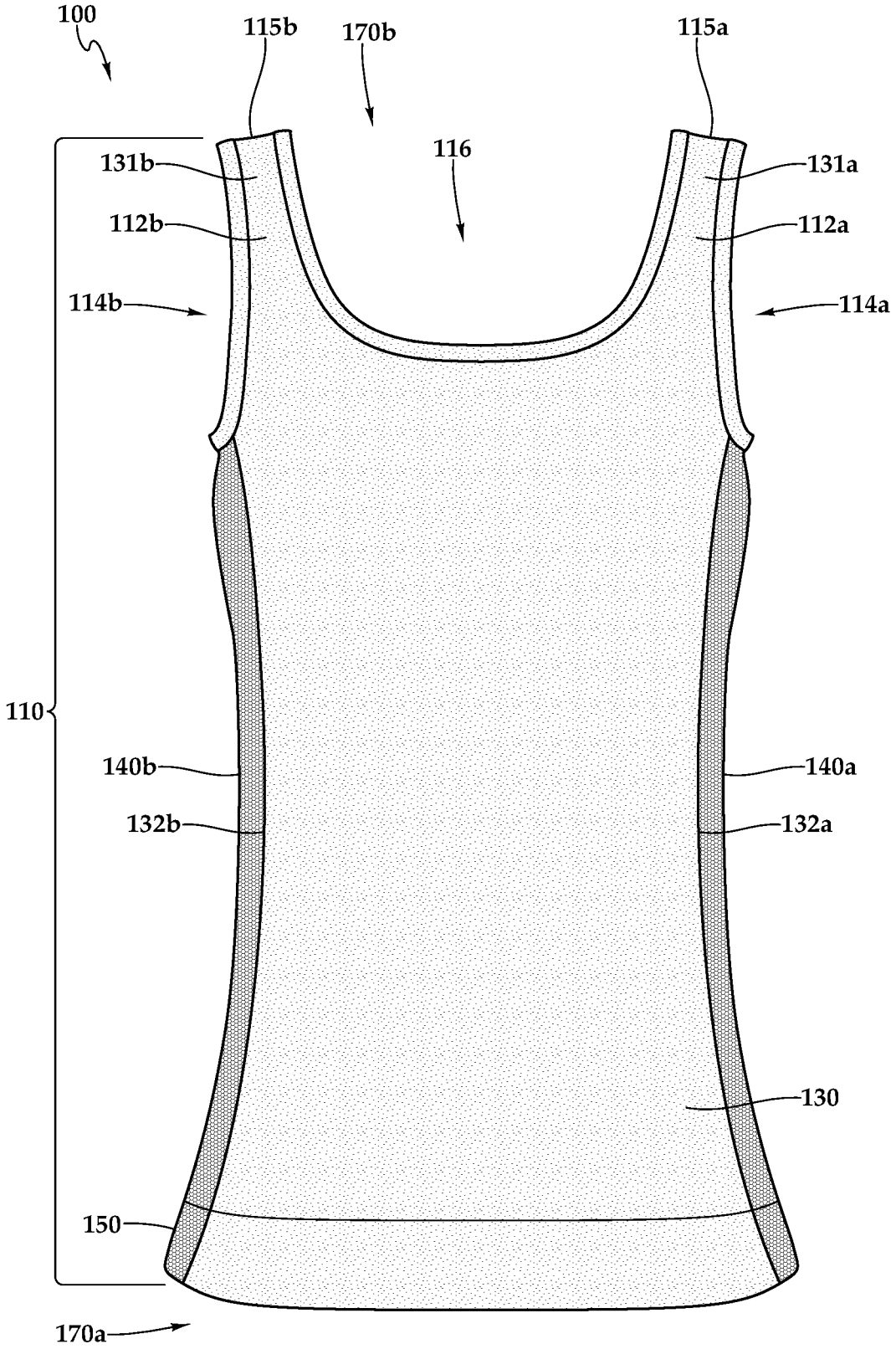
FIG. 2 is a rear view of an example undergarment.

Referring mainly to FIG. 2, the body 110 also includes a posterior knit region 130 having an outer edge 132*a* and an outer edge 132*b*. When the garment 100 is worn, the posterior knit region 130 covers, or overlays, a portion of a wearer's back. When worn, some, none, or all of the regions stretch to at least generally conform to the shape of the wearer.

The shoulder straps 112*a* and 112*b* include portions of the anterior knit region 120*b* and the posterior region 130. The shoulder straps 112*a* and 112*b* can be formed by trimming predetermined areas from the anterior knit region 120*b*, the posterior region 130, the outer edge 122*a*, and the outer edge 122*b* that correspond to the arm holes 114*a* and 114*b*, and by trimming predetermined areas from the anterior knit region 120*b* and the posterior region 130 that correspond to the neck hole 116. The remaining, untrimmed portions of the anterior knit region 120*a* form an anterior strap portion 121*a* and an anterior strap portion 121*b*. The remaining, untrimmed portions of the posterior knit region 130 form a posterior strap portion 131*a* and a posterior strap portion 131*b*. The anterior strap portion 121*a* and the posterior strap portion 131*a* are joined (e.g., sewn) at a seam 115*a* to form the shoulder strap 112*a*. The anterior strap portion 121*b* and the posterior strap portion 131*b* are joined (e.g., sewn) at a seam 115*b* to form the shoulder strap 112*b*.

Figure 3:
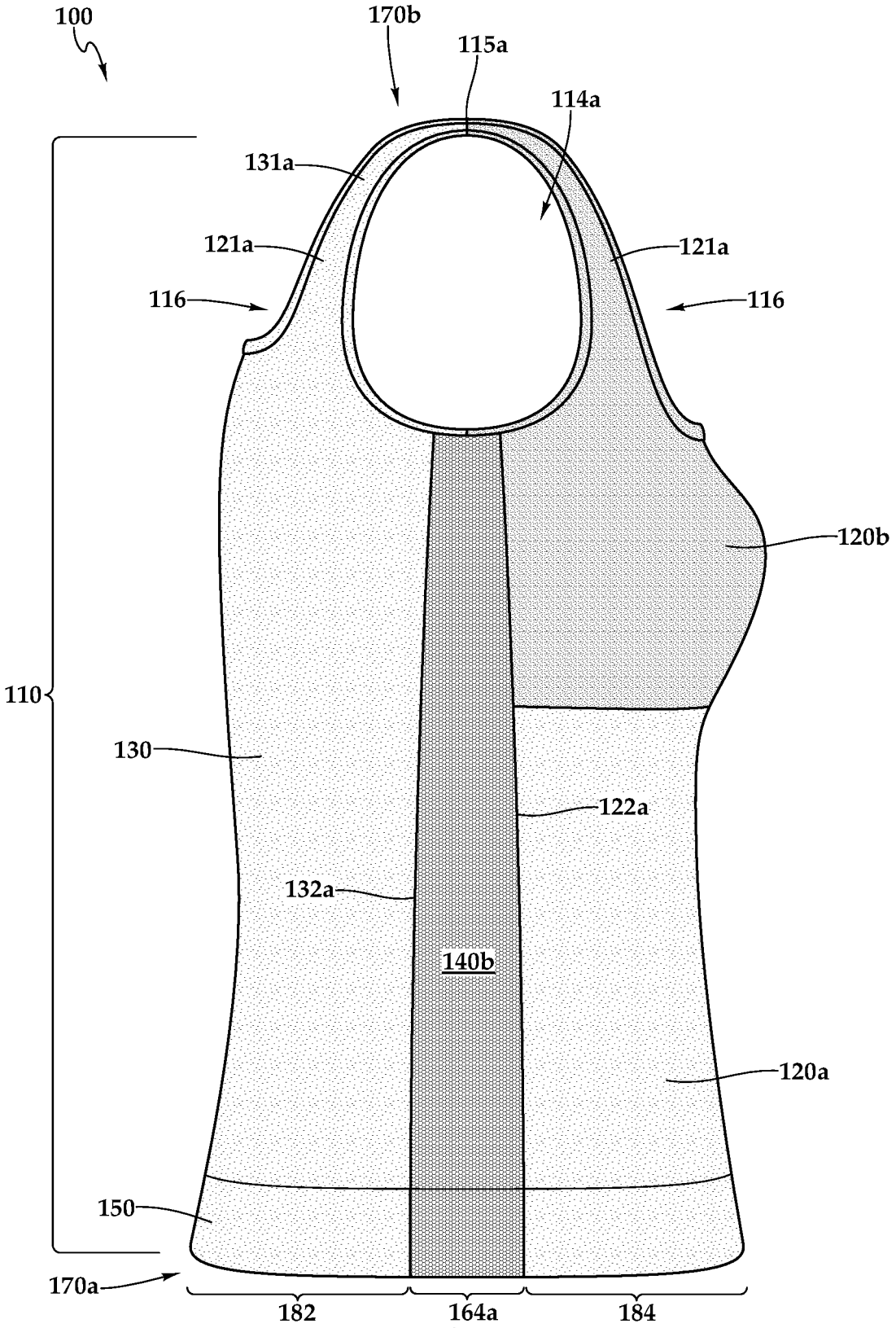
FIG. 3 is a right side view of the example undergarment.

Referring mainly now to FIG. 3, the body 110 also includes a lateral knit region 140*b* that extends between the outer edge 122*a* and the outer edge 132*a*. The lateral knit region 140*b* is arranged to cover (e.g., overlay, extend over, or stretch across) a portion of the wearer's right hip and a lateral portion of the wearer's right underarm when the garment 100 worn. In some embodiments, in a relaxed (e.g., unstretched) state, the lateral knit region 140*b* is about 1.6 inches wide and is about 15 inches long, although in some other embodiments the regions that are knit with the third knit pattern can have any appropriate size and/or may be used for up to the entirety of the garment 100. For example, the lateral knit region 140*b* can be substantially rectangular (as shown in FIG. 3), can increase and/or decrease in width along the longitudinal length of the lateral knit region 140*b*, or can be another shape generally along a lateral side of the torso of the wearer.

Figure 4:
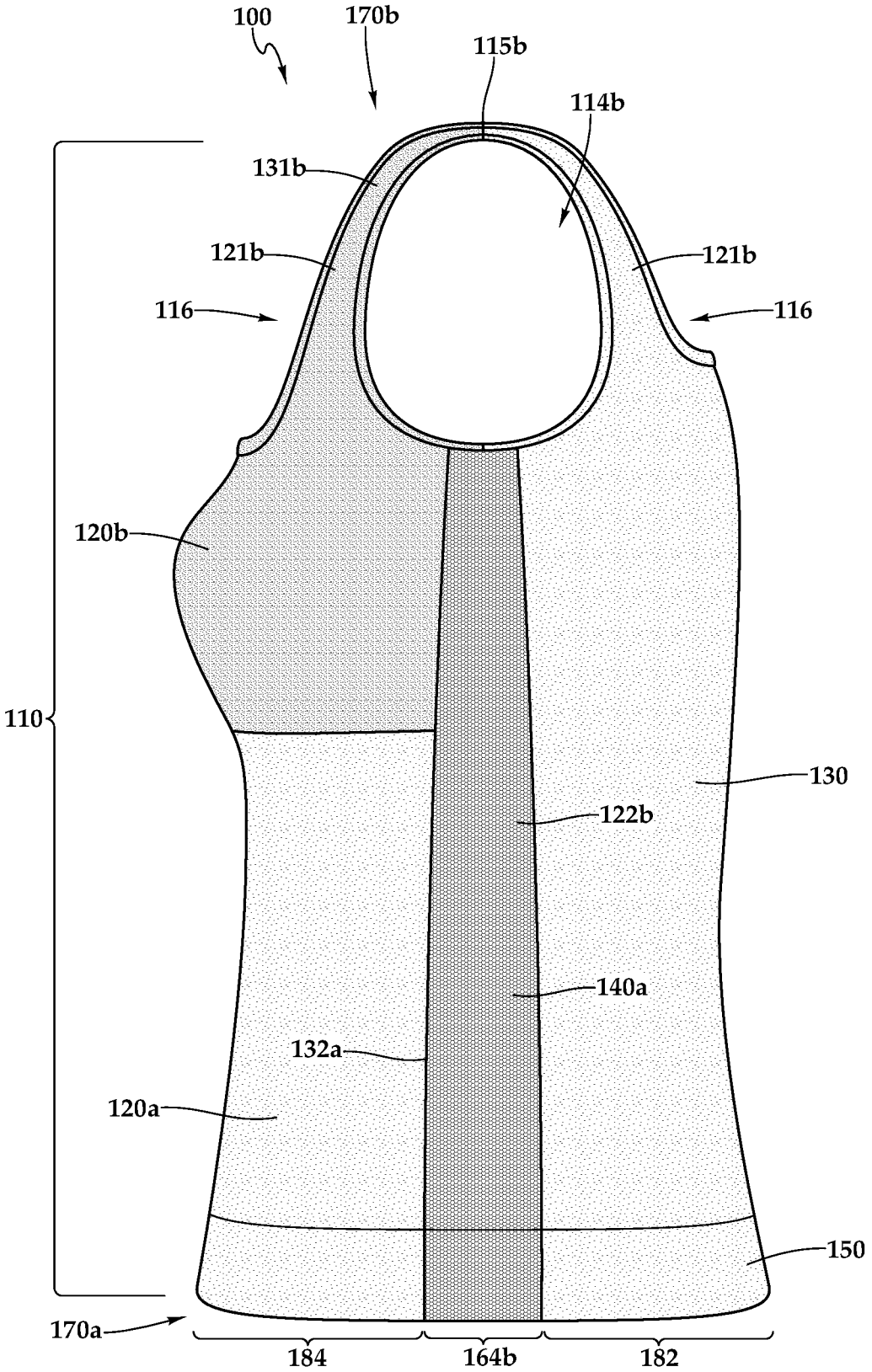
FIG. 4 is a left side view of the example undergarment.

Referring mainly now to FIG. 4, the body 110 also includes a lateral knit region 140*a* that extends between the outer edge 122*b* and the outer edge 132*b*. The lateral knit region 140*a* is arranged to cover (e.g., overlay, or stretch across) a portion of the wearer's left hip and a lateral portion of the wearer's left underarm area when the garment 100 worn. In some embodiments, in a relaxed (e.g., unstretched) state the lateral knit region 140*a* is about 1.6 inches wide and is about 15 inches long. However, the lateral knit region 140*a* can be similarly shaped as the lateral knit region 140*b* described earlier with respect to FIG. 3. For example, lateral knit region 140*a* can mirror the size, shape, and/or location of the lateral knit region 140*b* across a plane separating a right side of the garment 100 from a left side of the garment 100. In other instances, the lateral knit regions 140*a* and 140*b* can be sized, shaped, and/or located differently from each other. Although FIG. 3 is indicated as the left side of the garment and FIG. 4 is indicated as the right side of the garment, the garment sides and corresponding description can be opposite.

The body 110 is a generally tubular fabric structure. For example, the anterior knit region 120*a*, the anterior knit region 120*b*, the lateral knit region 140*a*, the posterior knit region 130, the lateral knit region 140*b*, and the waistband 150, can be circularly knit as a unitary, tubular body initially formed without seams (e.g., seamless). In some implementations, one or more of the regions are knit separately from the remainder and stitched to neighboring regions.

The anterior knit region 120*b* and the posterior knit region 130 are knit with a first knitting pattern. The lateral knit region 140*a* and the lateral knit region 140*b* are knit with a third knitting pattern that is different from the first knitting pattern. The anterior knit region 120*a* is knit with a second knitting pattern; however, in some embodiments the anterior knit region can be knit with the first knitting pattern or the third knitting pattern. In some embodiments, the first knitting pattern can be a plain knit pattern, for example, a single or double jersey knit structure. The third knitting pattern will be discussed further in the description of FIGS. 5A-5B. In some embodiments, the second knitting pattern can form a fabric that has an amount of stretch and/or breathability that is greater than the first knitting pattern. In some embodiments, the second knitting pattern can form a fabric that has an amount of stretch and breathability that is less than the third knitting pattern. In some embodiments, the first knitting pattern can be the same as the second knitting pattern.

Figure 5A:
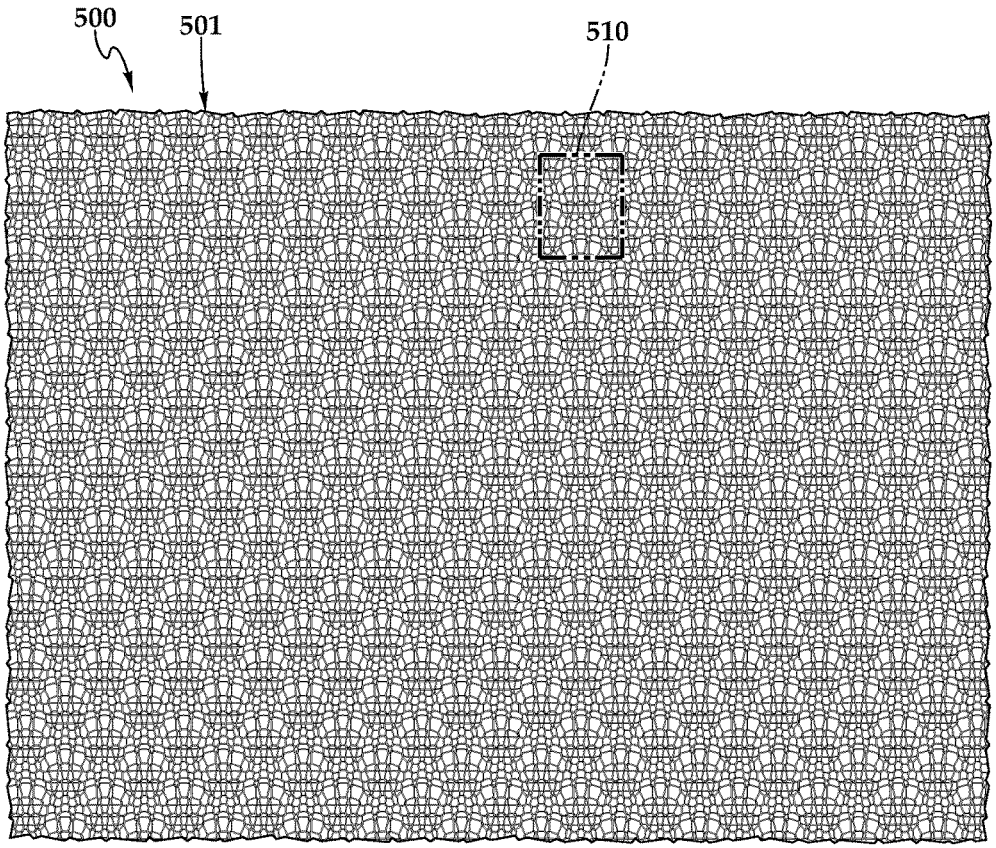
FIGS. 5A and 5B are enlarged views of an example knit region having an example stitch pattern.
Figure 5B:
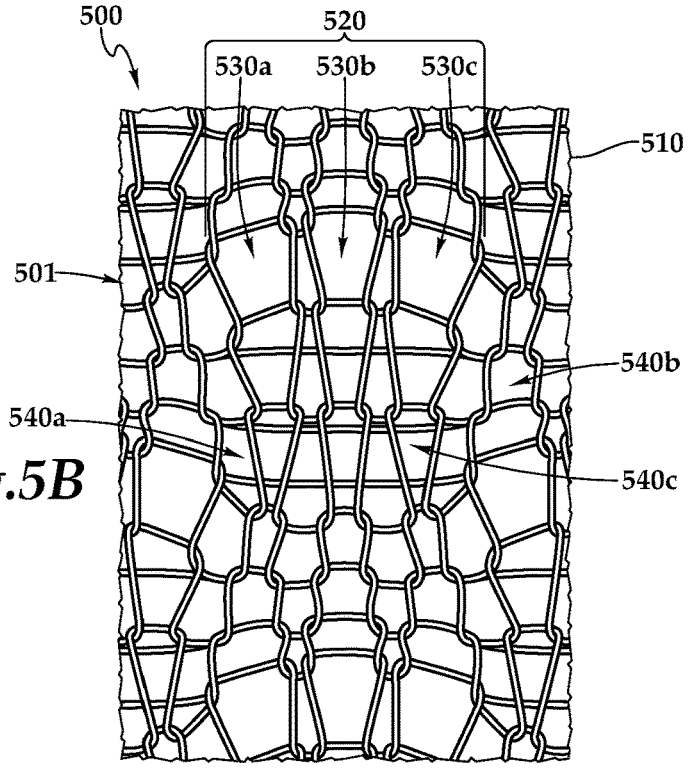

FIG. 5A is an enlarged view of a knit region 500 having an example stitch pattern 501. FIG. 5B is a further enlarged view of a section 510 of the knit region 500. In some embodiments, the stitch pattern 501 can be the third knitting pattern (e.g., used for the example lateral knit regions 140*a* and 140*b* of the body 110).

In some implementations, the example stitch pattern 501 is a knit mesh pattern of threads that, when knit together, can provide a textile having a weight of less than about 8.5 ounces per square yard (e.g., approximately 0.1859 g/sq. inch). For example, the knit mesh of the example stitch pattern 501 can provide a fabric having a weight of between 6.5 ounces per square yard and 8.5 ounces per square yard. In some implementations, the stitch pattern 501 can be used to create a fabric that exhibits about 1.5× to about 2× more stretchability and/or at least about 30% more breathability (e.g., air flow) than plain jersey fabric. In some instances where the second knitting pattern includes the example stitch pattern 501, these stretch properties and breathability properties can add comfort, support, and breathability to the wearer of the garment 100. For example, the knit mesh of the stitch pattern 501 can stretch up to 80% greater than its original, unstretched length.

Referring mainly to FIG. 5B, the stitch pattern 501 can include a repeating pattern of float knit structures, such as elastic 2×2 float knit patterns, 3×3 float knit patterns, or other float knit patterns. The stitch pattern 501 is knit using a combination of a ground yarn covered with an elastomer (e.g., spandex and/or other elastomer) that is float plated with a thread (e.g., nylon thread). The stitch pattern 501 includes a collection of groups such as a group 520. The group 520 includes three openings, such as an opening 530*a*, 530*b*, and 530*c*, arranged in a line. The groups are spaced apart by a collection of other openings, such as the openings 540*a*, 540*b*, and 540*c* that are smaller than the openings 530*a*-530 *c*. The regions having the stitch pattern 501 include about three hundred of the three-opening groups (e.g., about nine hundred of the larger openings such as 530*a*-530*c*), such as the group 520, per square inch when the region (e.g., the knit mesh of the lateral knit regions 140*a*-140*b*) is relaxed.

FIGS. 5A and 5B show the example knit region 500 and the example stitch pattern 501 in a substantially stretched state. For example, the openings 530*a*-530*c* and 540*a*-540*c* appear in a near-maximum stretch of the fabric; however, in a generally relaxed state, these openings 530*a*-530*c* and 540*a*-540*c* are not visible to the naked eye. The stitch pattern 501 of the knit region 500, including floats, create the openings 530*a*-530*c* and 540*a*-540*c* as a naturally occurring pattern when knit as described above (e.g., the fabric is not perforated after knitting to create openings).

Referring back to FIGS. 3 and 4, the lateral knit regions 140*a* and 140*b* include the third knit pattern, for example, the example stitch pattern 501 described earlier. FIGS. 3 and 4 show the lateral knit regions 140*b* and 140*a*, respectively, as including the knit mesh pattern in the entirety of the lateral knit regions 140*a* and 140*b*. However, the extent of the knit mesh pattern of the lateral knit regions 140*a* and 140*b* can be different. For example, the lateral knit regions 140*a* and 140*b* can include the knit mesh pattern in only parts of the lateral knit regions 140*a* and 140*b*, and further include a different knit structure (e.g., plain, jersey knit, alternate float pattern, or other knit pattern) in other portions of the lateral knit regions 140*a* and 140*b*.

Figure 6:
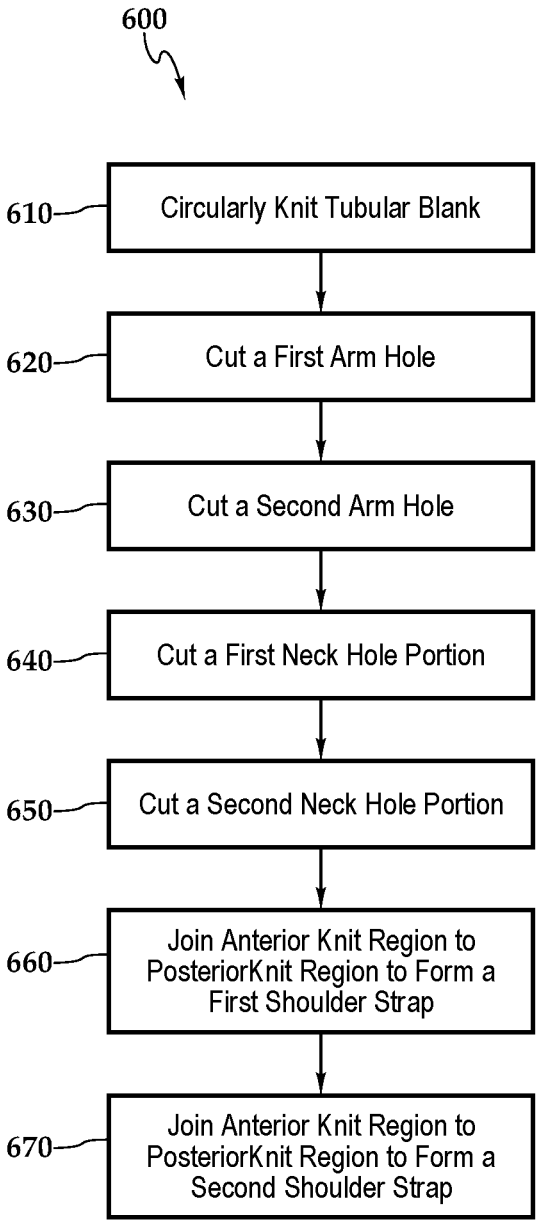
FIG. 6 is a flow diagram of an example process for making a garment.

FIG. 6 is a flow diagram of an example process 600 for making a garment. In some implementations, the process 600 can be a process for making the undergarment 100 of FIGS. 1-4.

At 610, a tubular blank is circularly knit to form a body of a garment. The body has a first end and a second end opposite the first. For example, the example garment body 110 can be circularly knit, and has a waist end 170*a* and a head end 170*b*.

The body 110 includes an anterior knit region having a first knitting pattern configured to stretch across a portion of a wearer's chest area, and a second knitting pattern configured to stretch across a portion of a wearer's abdominal area, having a first outer edge and second outer edge. For example, the example anterior knit region 120*a* can have a knit pattern that is different from that of the example anterior knit region 120*b* and/or the example lateral knit regions 140*a*, 140*b*, and the anterior knit regions 120*a* and 120*b* have the outer edges 122*a* and 122*b*.

The body 110 also includes a posterior knit region having the first knitting pattern, an outer edge, an inner edge, and is configured to extend or stretch about a portion of the wearer's back. For example, the example posterior knit region 130 can have a knit pattern that is different from that of the example anterior knit region 120*b* and/or the example lateral knit regions 140*a*, 140*b*, and has the outer edges 132*a* and 132*b*.

The body 110 also includes a first lateral knit region having a third knitting pattern different from the first knitting pattern, extending between the first outer edge and the third outer edge, and configured to extend or stretch about a portion of the wearer's left hip and a lateral portion of the wearer's left upper thigh. For example, the example lateral knit region 140*a* extends between the outer edge 122*a* and the outer edge 132*a*.

The body 110 also includes a second lateral knit region having the second knitting pattern, extending between the second outer edge and the fourth outer edge, and configured to extend or stretch about a portion of the wearer's right hip and a lateral portion of the wearer's right upper thigh. For example, the example lateral knit region 140*b* extends between the outer edge 122*b* and the outer edge 132*b*.

At 720, a first arm hole is cut proximal the first end through the first lateral knit region, a first portion of the anterior knit region, and a first portion of the posterior knit region. For example, the arm hole 114*a* can be defined by cutting the body 110 to remove portions of the example lateral knit region 140*a*, the example anterior knit region 120*b*, and the example posterior knit region 130 proximal to the head end 170*b*.

At 730, a second arm hole proximal the first end through the second lateral knit region, a second portion of the anterior knit region, and a second portion of the posterior knit region. For example, the arm hole 114*b* can be defined by cutting the body 110 to remove portions of the example lateral knit region 140*b*, the example anterior knit region 120*b*, and the example posterior knit region 130 proximal to the head end 170*b*.

At 740, a first neck hole portion is cut proximal the first end through a third portion of the anterior knit region. For example, a front portion of the neck hole 116 can be cut out from the example anterior knit region 120*b*.

At 750, a second neck hole portion is cut proximal the first end through a fourth portion of the posterior knit region. For example, a back portion of the neck hole 116 can be cut out from the example posterior knit region 130.

At 760, the anterior knit region is joined to the posterior knit region proximal the first end to form a first shoulder strap. For example, the remaining portions of the anterior knit region 120*b* and the posterior knit region 130, not cut away to form the neck hole 116 and the arm hole 114*a*, can be joined (e.g., stitched, adhered, bonded) near their free ends near the head end 170*b* to form the shoulder strap 112*a*.

At 770, the anterior knit region is joined to the posterior knit region proximal the first end to form a second shoulder strap. For example, the remaining portions of the anterior knit region 120*b* and the posterior knit region 130, not cut away to form the neck hole 116 and the arm hole 114*b*, can be joined (e.g., stitched, adhered, bonded) near their free ends near the head end 170*b* to form the shoulder strap 112*b*.

In some implementations, the process 700 can also include knitting the third knitting pattern in a knit mesh pattern. In some implementations, the regions having the third knitting pattern can have a weight of less than 8.5 ounces per square yard. For example, the lateral knit regions 140*a*, 140*b* can be knit with the example stitch pattern 501 shown in FIGS. 5A and 5B.

In some implementations, the regions having the third knitting pattern can include an elastic 2×2 float knit structure that includes a ground yarn covered with an elastomer, and is float plated with a nylon thread. In some implementations, the third knitting pattern can include a collection of groups of three first openings arranged in a line, visible when stretched, wherein the groups are spaced apart by a plurality of second openings that are smaller than the first openings, and the regions having the third knitting pattern include about three hundred of the groups per square inch when the knit mesh is relaxed. For example, the example stitch pattern 501 includes the group 520 of the three openings 530*a*-530*c* arranged in a line, which is spaced apart from other groups by smaller openings such as the openings 540*a*-540*c*.

In some implementations, the second knitting pattern can be a knit mesh pattern having greater stretch and breathability than the first knitting pattern, but a lesser stretch and breathability than the third knitting pattern. For example, the anterior knit region 120*b* can have greater stretch and/or breathability than the anterior knit region 120*a*, but less stretch and/or breathability than the lateral knit regions 140*a* or 140*b*. In some implementations, the second knitting pattern can be the first knitting pattern. For example, the anterior knit region 120*a* and the anterior knit region 120*b* can both have the same stitch pattern, which may be different from the stitch pattern used for the lateral knit regions 140*a*, 140*b*, and the posterior knit region 130. In some implementations, the second knitting pattern can be the third knitting pattern. For example, the anterior knit region 120*a* can have the same stitch pattern as the lateral knit regions 140*a* or 140*b*, and can have stitch pattern that is different from the stitch pattern used to form the anterior knit portion 120*a* and the posterior knit portion 130.

In some implementations, the process 600 can also include circularly knitting a tubular blank to form a tubular waistband of the garment, and stitching the tubular waistband to the first anterior knit region, the first lateral knit region, the posterior knit region, and the second lateral knit region at the first end of the body. For example, the example waistband 150 can be circularly knit and then stitched to the example body 110 at the waist end 170*a*.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described garment. Accordingly, other implementations are within the scope of the following claims.

What is claimed is:

1. A garment comprising:

a body having a first end and a second end opposite the first end, the body comprising:

an anterior knit region having a first knitting pattern configured to stretch across a portion of a wearer's abdominal area, a second knitting pattern configured to stretch across a portion of a wearer's chest area, a first outer edge and a second outer edge;

a posterior knit region having the first knitting pattern, a third outer edge and a fourth outer edge, and configured to stretch about a portion of the wearer's back;

a first lateral knit region having a third knitting pattern different from the first knitting pattern, extending between the first outer edge of the anterior knit region and the third outer edge of the posterior knit region, and configured to stretch about a portion of the wearer's left lateral area and a lateral portion of the wearer's left hip, wherein the third knitting pattern is a knit mesh pattern and wherein the second knitting pattern is a knit mesh pattern having greater stretch and breathability than the first knitting pattern, but a lesser stretch and breathability than the third knitting pattern; and a second lateral knit region having the third knitting pattern, extending between the second outer edge of the anterior knit region and the fourth outer edge of the posterior knit region, and configured to stretch about a portion of the wearer's right lateral area and a lateral portion of the wearer's right hip.

2. The garment of claim 1, wherein the anterior knit region, the first lateral knit region, the posterior knit region, and the second lateral knit region are formed together as a circularly knit, tubular body.

3. The garment of claim 2, wherein the wearer's chest area comprises the wearer's breasts.

4. The garment of claim 1, wherein regions having the third knitting pattern have a weight of less than 8.5 ounces per square yard.

5. The garment of claim 1, wherein regions having the third knitting pattern are elastic 2×2 float knit structures comprising a ground yarn covered with an elastomer that is float plated with a nylon thread.

6. The garment of claim 1, wherein the third knitting pattern comprises a plurality of groups of three first openings arranged in a line, wherein the groups are spaced apart by a plurality of second openings that are smaller than the first openings, and regions having the third knitting pattern comprise about three-hundred of the groups per square inch when the knit mesh is relaxed.

7. The garment of claim 1, further comprising a tubular waistband attached to the anterior knit region, the first lateral knit region, the posterior knit region, and the second lateral knit region at the second end of the body.

8. The garment of claim 1, wherein the first knitting pattern comprises a single or double jersey knit structure.

9. The garment of claim 1, wherein the first knitting pattern is the same as the second knitting pattern.

10. The garment of claim 1, wherein the garment is an undergarment.

11. A method of making a garment, the method comprising:

circularly knitting a tubular blank to form a body of a garment, the body having a first end and a second end opposite the first end and comprising:

an anterior knit region having a first knitting pattern configured to stretch across a portion of a wearer's abdominal area, and a second knitting pattern configured to stretch across a portion of a wearer's chest area, having a first outer edge and a second outer edge;

a posterior knit region having the first knitting pattern, having a third outer edge and a fourth outer edge, and configured to stretch about a portion of the wearer's back;

a first lateral knit region having a third knitting pattern different from the first knitting pattern, extending between the first outer edge and the third outer edge, and configured to stretch about a portion of the wearer's left lateral area and a lateral portion of the wearer's left hip, wherein the third knitting pattern is a knit mesh pattern and wherein the second knitting pattern is a knit mesh pattern having greater stretch and breathability than the first knitting pattern, but a lesser stretch and breathability than the third knitting pattern; and a second lateral knit region having the third knitting pattern, extending between the second outer edge and the fourth outer edge, and configured to stretch about a portion of the wearer's right lateral area and a lateral portion of the wearer's right hip;

cutting a first arm hole proximal the first end through the first lateral knit region, a first portion of the anterior knit region, and a first portion of the posterior knit region;

cutting a second arm hole proximal the first end through the second lateral knit region, a second portion of the anterior knit region, and a second portion of the posterior knit region;

cutting a first neck hole portion proximal the first end through a third portion of the anterior knit region;

cutting a second neck hole portion proximal the first end through a fourth portion of the posterior knit region;

joining the anterior knit region to the posterior knit region proximal the first end to form a first shoulder strap; and joining the anterior knit region to the posterior knit region proximal the first end to form a second shoulder strap.

12. The method of claim 11, wherein regions having the third knitting pattern have a weight of less than 8.5 ounces per square yard.

13. The method of claim 11, wherein regions having the third knitting pattern are elastic 2×2 float knit structures comprising a ground yarn covered with an elastomer float plated with a nylon thread.

14. The method of claim 11, wherein the third knitting pattern comprises a plurality of groups of three first openings arranged in a line, wherein the groups are spaced apart by a plurality of second openings that are smaller than the first openings, and the regions having the third knitting pattern comprise about three-hundred of the groups per square inch when the knit mesh is relaxed.

15. The method of claim 11, wherein the first knitting pattern is a single or double jersey knit structure.

16. The method of claim 11, wherein the first knitting pattern is the same as the second knitting pattern.

* * * * *